US005917289A

United States Patent [19]

Nerone et al.

[11] Patent Number: 5,917,289

[45] **Date of Patent: *Jun. 29, 1999**

[54] LAMP BALLAST WITH TRIGGERLESS STARTING CIRCUIT

[75] Inventors: Louis R. Nerone, Brecksville; David J. Kachmarik, Strongsville; Michael M. Secen, Mentor, all of Ohio

[73] Assignee: General Electric Company, Schenectady, N.Y.

[ * ] Notice: This patent is subject to a terminal disclaimer.

[21] Appl. No.: 08/897,345

[22] Filed: Jul. 21, 1997

Related U.S. Application Data

[63] Continuation-in-part of application No. 08/794,071, Feb. 4, 1997, abandoned.

[51] Int. Cl.[6] ..... H05B 37/02

[52] U.S. Cl. ..... 315/209 R; 315/DIG. 5; 315/DIG. 7; 315/244

[58] Field of Search ..... 315/209 R, DIG. 5, 315/DIG. 7, 244, 219

[56] References Cited

U.S. PATENT DOCUMENTS

| | | | |
|---|---|---|---|
| 4,463,286 | 7/1984 | Justice | 315/219 |
| 4,469,988 | 9/1984 | Cronin | 315/209 R |
| 4,546,290 | 10/1985 | Kerekes | 315/209 R |
| 4,588,925 | 5/1986 | Fahnrich et al. | 315/101 |
| 4,647,817 | 3/1987 | Fahnrich et al. | 315/104 |
| 4,677,345 | 6/1987 | Nilssen | 315/209 R |
| 4,692,667 | 9/1987 | Nilssen | 315/209 R |
| 4,937,470 | 6/1990 | Zeller | 323/289 X |
| 4,945,278 | 7/1990 | Chern | 315/209 R |
| 5,223,767 | 6/1993 | Kulka | 315/209 R |
| 5,309,062 | 5/1994 | Perkins et al. | 315/53 |
| 5,341,068 | 8/1994 | Nerone | 315/219 |
| 5,349,270 | 9/1994 | Roll et al. | 315/209 R |
| 5,387,847 | 2/1995 | Wood | 315/209 R |
| 5,406,177 | 4/1995 | Nerone | 315/307 |
| 5,514,981 | 5/1996 | Tam et al. | 327/166 X |

*Primary Examiner*—Arnold Kinkead
*Attorney, Agent, or Firm*—Charles E. Bruzga, Esq.

[57] ABSTRACT

A ballast circuit for a gas discharge lamp comprises a resonant load circuit including the lamp. A d.c.-to-a.c. converter circuit induces an a.c. current in the resonant load circuit. The converter circuit comprises first and second switches serially connected between a bus conductor at a d.c. voltage and a reference conductor, and being connected together at a common node through which the a.c. load current flows. The first and second switches each comprise a reference node and a control node, the voltage between such nodes determining the conduction state of the associated switch. The respective reference nodes of the first and second switches are interconnected at the common node. The respective control nodes of the first and second switches are interconnected. An inductance is connected between the control nodes and the common node. A starting pulse-supplying capacitance is connected in series with the inductance, between the control nodes and the common node. A network is connected to the control nodes for supplying the starting pulse-supplying capacitance with charge so as to create a starting pulse during lamp starting, and for setting the voltage of the control nodes sufficiently close to that of the common node during steady state lamp operation so as to prevent the capacitance from supplying a starting pulse during the steady state lamp operation. A polarity-determining impedance is connected between the common node and one of the bus conductor and the reference conductor, to set the initial polarity of pulse to be generated by the starting pulse-supplying capacitor.

16 Claims, 6 Drawing Sheets

LAMP BALLAST WITH TRIGGERLESS STARTING CIRCUIT

This is a continuation-in-part of application Ser. No. 08/794,071, filed on Feb. 4, 1997 now abandoned.

FIELD OF THE INVENTION

The present invention relates to ballasts, or power supply, circuits for gas discharge lamps of the type employing regenerative gate drive circuitry for controlling a pair of serially connected switches of an d.c.-to-a.c. converter. A first aspect of the invention relates to such a ballast circuit employing an inductance in the gate drive circuitry to adjust the phase of a voltage that controls the serially connected switches. A second aspect of the invention, claimed herein, relates to the mentioned type of ballast circuit that employs a novel circuit for starting regenerative operation of the gate drive circuitry.

BACKGROUND OF THE INVENTION

Regarding a first aspect of the invention, typical ballast circuits for a gas discharge lamp include a pair of serially connected MOSFETs or other switches, which convert direct current to alternating current for supplying a resonant load circuit in which the gas discharge lamp is positioned. Various types of regenerative gate drive circuits have been proposed for controlling the pair of switches. For example, U.S. Pat. No. 5,349,270 to Roll et al. ("Roll") discloses gate drive circuitry employing an R-C (resistive-capacitive) circuit for adjusting the phase of gate-to-source voltage with respect to the phase of current in the resonant load circuit. A drawback of such gate drive circuitry is that the phase angle of the resonant load circuit moves towards 90° instead of toward 0° as the capacitor of the R-C circuit becomes clamped, typically by a pair of back-to-back connected Zener diodes. These diodes are used to limit the voltage applied to the gate of MOSFET switches to prevent damage to such switches. The resulting large phase shift prevents a sufficiently high output voltage that would assure reliable ignition of the lamp, at least without sacrificing ballast efficiency.

Additional drawbacks of the foregoing R-C circuits are soft turn-off of the MOSFETs, resulting in poor switching, and a slowly decaying ramp of voltage provided to the R-C circuit, causing poor regulation of lamp power and undesirable variations in line voltage and arc impedance.

Regarding a second aspect of the invention, it would be desirable to provide a simple starting circuit for initiating regenerative action of gate drive circuitry for controlling the switches of a d.c.-to-a.c. converter in ballast circuits of the mentioned type.

OBJECTS AND SUMMARY OF THE INVENTION

It is an object of the first aspect of the invention to provide a gas discharge lamp ballast circuit of the type employing regenerative gate drive circuitry for controlling a pair of serially connected switches of an d.c.-to-a.c. converter, wherein the phase angle between a resonant load current and a control voltage for the switches moves towards 0° during lamp ignition, assuring reliable lamp starting.

A further object of the first aspect of the invention is to provide a ballast circuit of the foregoing type having a simplified construction compared to the mentioned prior art circuit of Roll, for instance.

An object of the second aspect of the invention is to provide a simple starting circuit for initiating regenerative action of gate drive circuitry for controlling the switches of a d.c.-to-a.c. converter in ballast circuits of the mentioned type.

A further object of the second aspect of the invention is to provide a simple starting circuit of the foregoing type that may be used in other ballast circuits which also employ a pair of serially connected switches in a d.c.-to-a.c. converter.

In accordance with a second aspect of the invention, claimed herein, there is provided a ballast circuit for a gas discharge lamp, comprising a resonant load circuit including the lamp. A d.c.-to-a.c. converter circuit induces an a.c. current in the resonant load circuit. The converter circuit comprises first and second switches serially connected between a bus conductor at a d.c. voltage and a reference conductor, and being connected together at a common node through which the a.c. load current flows. The first and second switches each comprise a reference node and a control node, the voltage between such nodes determining the conduction state of the associated switch. The respective reference nodes of the first and second switches are interconnected at the common node. The respective control nodes of the first and second switches are interconnected. An inductance is connected between the control nodes and the common node. A starting pulse-supplying capacitance is connected in series with the inductance, between the control nodes and the common node. A network is connected to the control nodes for supplying the starting pulse-supplying capacitance with charge so as to create a starting pulse during lamp starting, and for setting the voltage of the control nodes sufficiently close to that of the common node during steady state lamp operation so as to prevent the capacitance from supplying a starting pulse during the steady state lamp operation. A polarity-determining impedance ($R_3$, $R_3'$) is connected between the common node and one of the bus conductor and the reference conductor, to set the initial polarity of pulse to be generated by the starting pulse-supplying capacitor.

BRIEF DESCRIPTION OF THE DRAWINGS

The foregoing objects and further advantages and features of the invention will become apparent from the following description when taken in conjunction with the drawing, in which like reference numerals refer to like parts, and in which.

DETAILED DESCRIPTION OF THE PREFERRED EMBODIMENTS

First Aspect of Invention

The first aspect of the invention will now be described in connection with FIGS. 1–6B.

Figure 1:
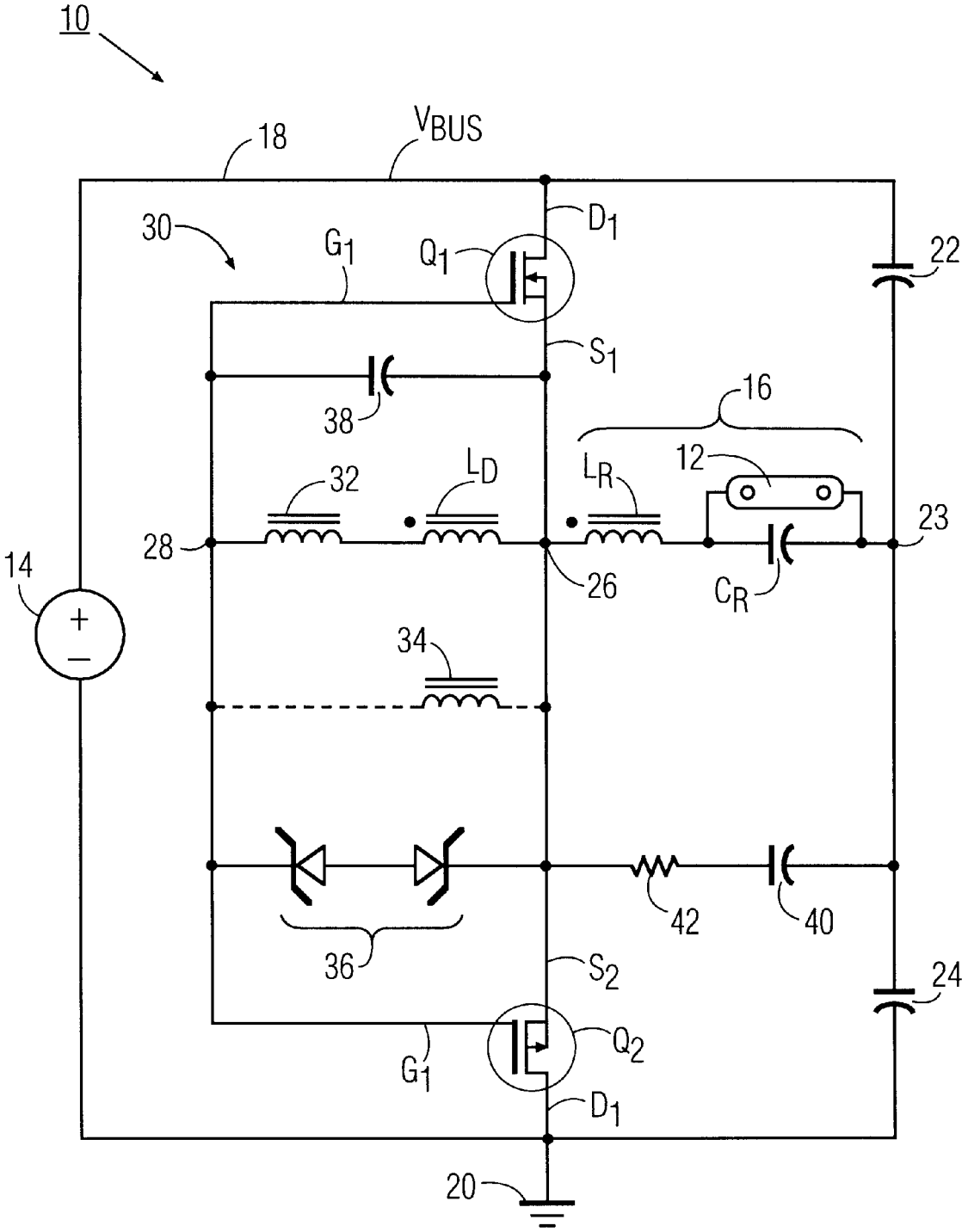
FIG. 1 is a schematic diagram of a ballast circuit for a gas discharge lamp employing complementary switches in a d.c.-to-a.c. converter, in accordance with a first aspect of the invention.

FIG. 1 shows a ballast circuit 10 for a gas discharge lamp 12 in accordance with a first aspect of the invention. Switches $Q_1$ and $Q_2$ are respectively controlled to convert d.c. current from a source 14, such as the output of a full-wave bridge (not shown), to a.c. current received by a resonant load circuit 16, comprising a resonant inductor $L_R$ and a resonant capacitor $C_R$. D.c. bus voltage $V_{BUS}$ exists between bus conductor 18 and reference conductor 20, shown for convenience as a ground. Resonant load circuit 16 also includes lamp 12, which, as shown, may be shunted across resonant capacitor $C_R$. Capacitors 22 and 24 are standard "bridge" capacitors for maintaining their commonly connected node 23 at about ½ bus voltage $V_{BUS}$. Other arrangements for interconnecting lamp 12 in resonant load circuit 16 and arrangements alternative to bridge capacitors 18 and 24 are known in the art.

In ballast 10 of FIG. 1, switches $Q_1$ and $Q_2$ are complementary to each other in the sense, for instance, that switch $Q_1$ may be an n-channel enhancement mode device as shown, and switch $Q_2$ a p-channel enhancement mode device as shown. These are known forms of MOSFET switches, but Bipolar Junction Transistor switches could also be used, for instance. Each switch $Q_1$ and $Q_2$ has a respective gate, or control terminal, $G_1$ or $G_2$. The voltage from gate $G_1$ to source $S_1$ of switch $Q_1$ controls the conduction state of that switch. Similarly, the voltage from gate $G_2$ to source $S_2$ of switch $Q_2$ controls the conduction state of that switch. As shown, sources $S_1$ and $S_2$ are connected together at a common node 26. With gates $G_1$ and $G_2$ interconnected at a common control node 28, the single voltage between control node 28 and common node 26 controls the conduction states of both switches $Q_1$ and $Q_2$. The drains $D_1$ and $D_2$ of the switches are connected to bus conductor 18 and reference conductor 20, respectively.

Gate drive circuit 30, connected between control node 28 and common node 26, controls the conduction states of switches $Q_1$ and $Q_2$. Gate drive circuit 30 includes a driving inductor $L_D$ that is mutually coupled to resonant inductor $L_R$, and is connected at one end to common node 26. The end of inductor $L_R$ connected to node 26 may be a tap from a transformer winding forming inductors $L_D$ and $L_R$. Inductors $L_D$ and $L_R$ are poled in accordance with the solid dots shown adjacent the symbols for these inductors. Driving inductor $L_D$ provides the driving energy for operation of gate drive circuit 30. A second inductor 32 is serially connected to driving inductor $L_D$, between node 28 and inductor $L_D$ As will be further explained below, second inductor 32 is used to adjust the phase angle of the gate-to-source voltage appearing between nodes 28 and 26. A further inductor 34 may be used in conjunction with inductor 32, but is not required, and so the conductors leading to inductor 34 are shown as broken. A bidirectional voltage clamp 36 between nodes 28 and 26 clamps positive and negative excursions of gate-to-source voltage to respective limits determined, e.g., by the voltage ratings of the back-to-back Zener diodes shown. A capacitor 38 is preferably provided between nodes 28 and 26 to predicably limit the rate of change of gate-to-source voltage between nodes 28 and 26. This beneficially assures, for instance, a dead time interval in the switching modes of switches $Q_1$ and $Q_2$ wherein both switches are off between the times of either switch being turned on.

An optional snubber circuit formed of a capacitor 40 and, optionally, a resistor 42 may be employed as is conventional, and described, for instance, in U.S. Pat. No. 5,382,882, issued on Jan. 17, 1995, to the present inventor, and commonly assigned.

Figure 2:
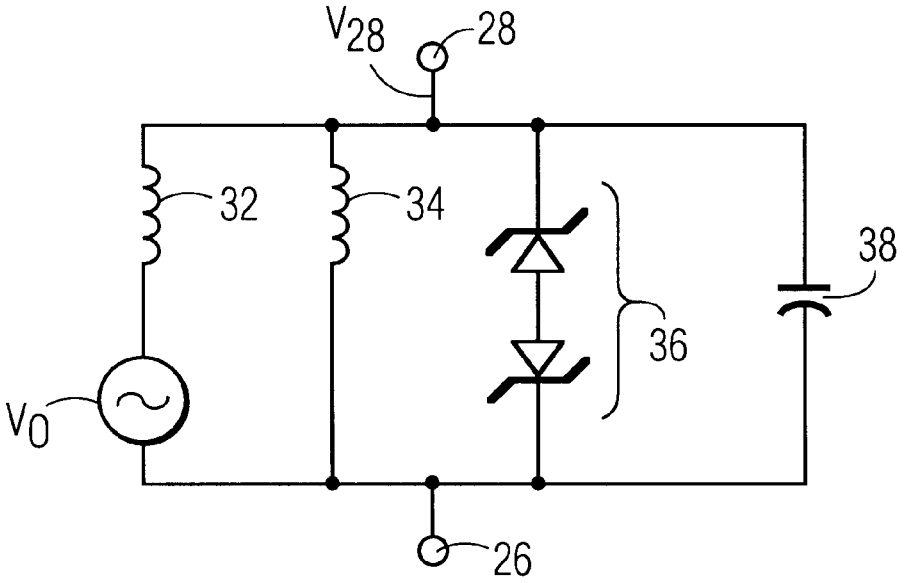
FIG. 2 is an equivalent circuit diagram for gate drive circuit 30 of FIG. 1.

FIG. 2 shows a circuit model of gate drive circuit 30 of FIG. 1. When the Zener diodes 36 are conducting, the nodal equation about node 28 is as follows:

$$-(1/L_{32})\int V_o dt+(1/L_{32}+1/L_{34})\int V_{28}dt+I_{36}=0 \quad (1)$$

where, referring to components of FIG. 1, $L_{32}$ is the inductance of inductor 32;

$V_o$ is the driving voltage from driving inductor $L_D$;

$L_{34}$ is the inductance of inductor 34;

$V_{28}$ is the voltage of node 28 with respect to node 26; and $I_{36}$ is the current through the bidirectional clamp 36.

In the circuit of FIG. 2, the current through capacitor 38 is zero while the voltage clamp 36 is on.

Figure 3:
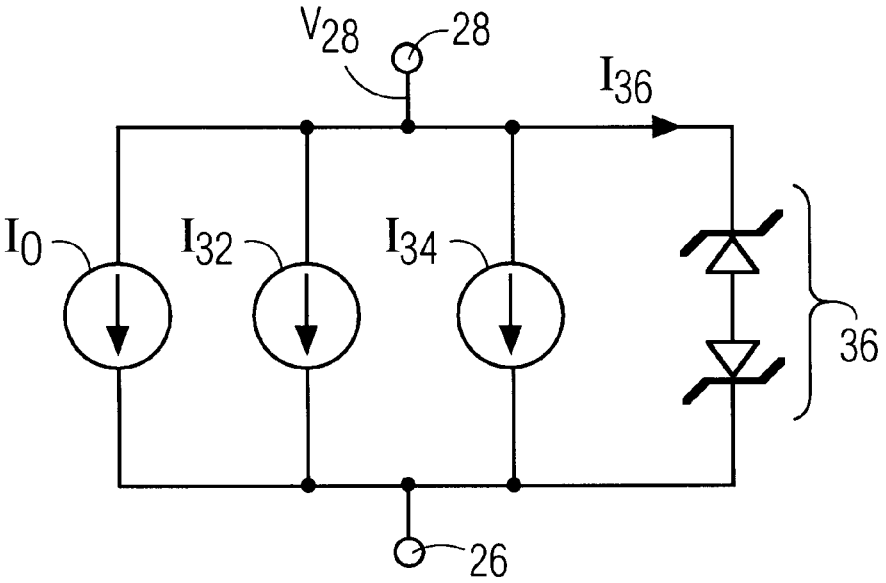
FIG. 3 is an another equivalent circuit diagram for gate drive circuit 30 of FIG. 1.

The circuit of FIG. 2 can be redrawn as shown in FIG. 3 to show only the currents as dependent sources, where $I_o$ is the component of current due to voltage $V_o$ (defined above) across driving inductor $L_D$ (FIG. 1). The equation for current $I_o$ can be written as follows:

$$I_o=(1/L_{32})\int V_0 dt \quad (2)$$

The equation for current $I_{32}$, the current in inductor 32, can be written as follows:

$$I_{32}=(1/L_{32})\int V_{28}dt \quad (3)$$

The equation for current $I_{34}$, the current in inductor 34, can be written as follows:

$$I_{34}=(1/L_{34})\int V_{28}dt \quad (4)$$

As can be appreciated from the foregoing equations (2)–(4), the value of inductor $L_{32}$ can be changed to include the values of both inductors $L_{32}$ and $L_{34}$. The new value for inductor $L_{32}$ is simply the parallel combination of the values for inductors 32 and 34.

Figure 4:
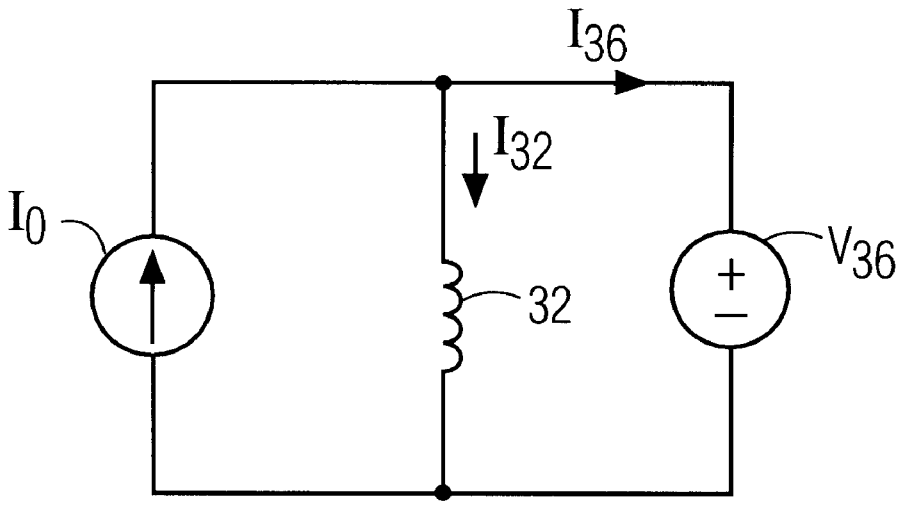
FIG. 4 is an equivalent circuit for gate drive circuit 30 of FIG. 1 when Zener diodes 36 of FIG. 1 are conducting.
Figure 5:
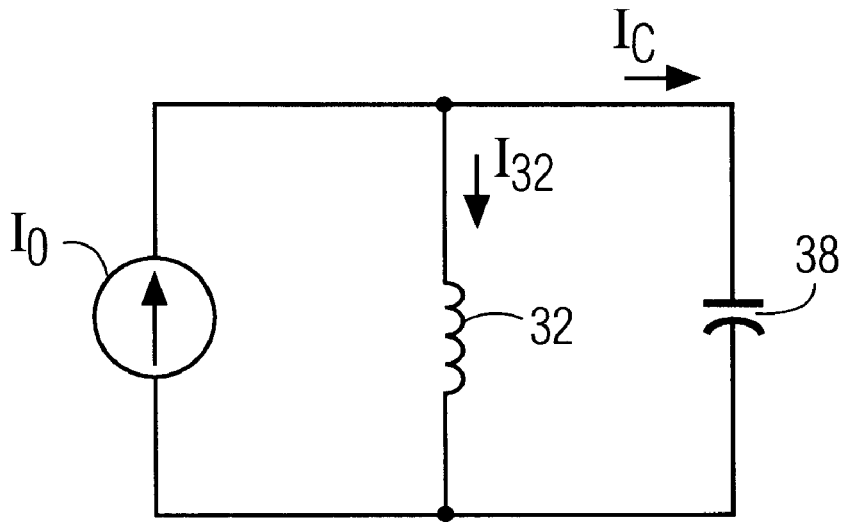
FIG. 5 is an equivalent circuit for gate drive circuit 30 of FIG. 1 when Zener diodes 36 of FIG. 1 are not conducting, and the voltage across capacitor 38 of FIG. 1 is changing state.

Now, with inductor 34 removed from the circuit of FIG. 1, the following circuit analysis explains operation of gate drive circuit 34. Referring to FIG. 4, with terms such as $I_o$ as defined above, the condition when the back-to-back Zener diodes of bidirectional voltage clamp 36 are conducting is now explained. Current $I_o$ can be expressed by the following equation:

$$I_o=(L_R/nL_{32})I_R \quad (5)$$

where $L_R$ (FIG. 1) is the resonant inductor;

n is the turns ratio as between $L_R$ and $L_D$; and $I_R$ is the current in resonant inductor $L_R$.

Current $I_{36}$ through Zener diodes 36 can be expressed by the following equation:

$$I_{36}=I_0-I_{32} \tag{6}$$

With Zener diodes 36 conducting, current through capacitor 38 (FIG. 1) is zero, and the magnitude of $I_o$ is greater than $I_{32}$. At this time, voltage $V_{36}$ across Zener diodes 36 (i.e. the gate-to-source voltage) is plus or minus the rated clamping voltage of one of the active, or clamping, Zener diode (e.g. 7.5 volts) plus the diode drop across the other, non-clamping, diode (e.g. 0.7 volts).

Then, with Zener diodes 36 not conducting, the voltage across capacitor 38 (FIG. 1) changes state from a negative value to a positive value, or vice-versa. The value of such voltage during this change is sufficient to cause one of switches $Q_1$ and $Q_2$ to be turned on, and the other turned off. As mentioned above, capacitor 38 assures a predictable rate of change of the gate-to-source voltage. Further, with Zener diodes 36 not conducting, the magnitude of $I_{32}$ is greater than the value of $I_o$. At this time, current $I_C$ in capacitor 38 can be expressed as follows:

$$I_C=I_o-I_{32} \tag{7}$$

Current $I_{32}$ is a triangular waveform. Current $I_{36}$ (FIG. 4) is the difference between $I_o$ and $I_{32}$ while the gate-to-source voltage is constant (i.e., Zener diodes 36 conducting). Current $I_C$ is the current produced by the difference between $I_o$ and $I_{32}$ when Zener diodes 36 are not conducting. Thus, $I_C$ causes the voltage across capacitor 38 (i.e., the gate-to-source voltage) to change state, thereby causing switches $Q_1$ and $Q_2$ to switch as described. The gate-to-source voltage is approximately a square wave, with the transitions from positive to negative voltage, and vice-versa, made predictable by the inclusion of capacitor 38.

Figure 6A:
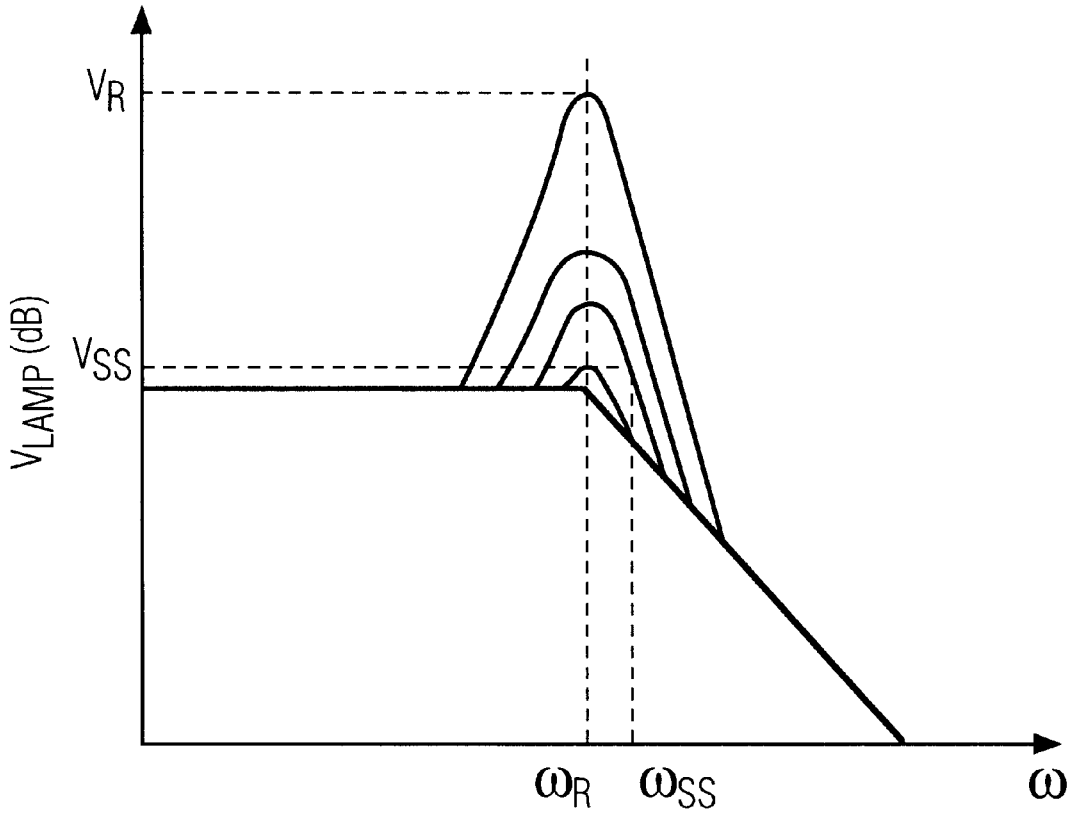
FIG. 6A is a simplified lamp voltage-versus-angular frequency graph illustrating operating points for lamp ignition and for steady state modes of operation.
Figure 6B:
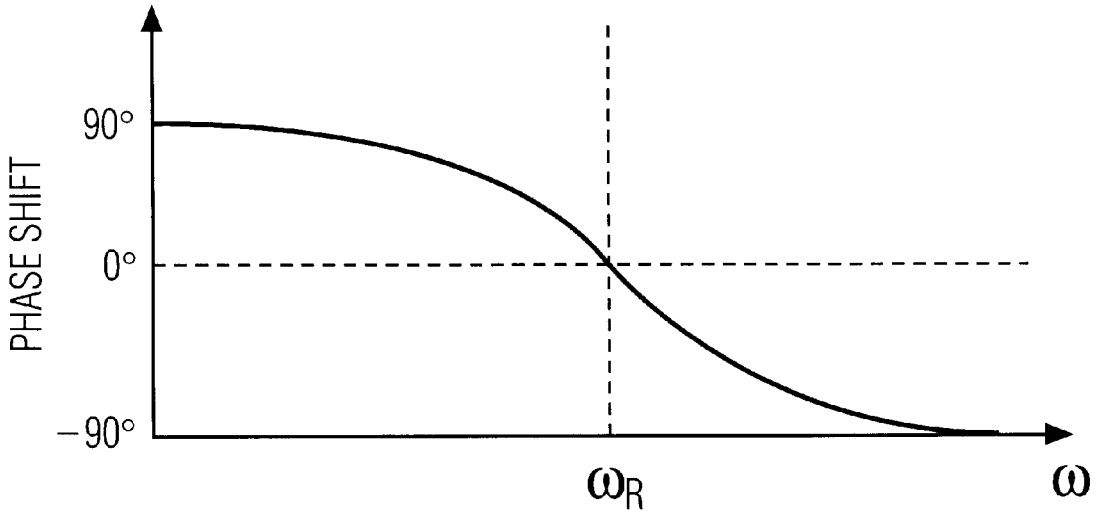
FIG. 6B illustrates the phase angle between a fundamental frequency component of a voltage of a resonant load circuit and the resonant load current as a function of angular frequency of operation.

Beneficially, the use of gate drive circuit 30 of FIG. 1 results in the phase shift (or angle) between the fundamental frequency component of the resonant voltage between node 26 and node 23 and the current in resonant load circuit 16 (FIG. 1) approaching 0° during ignition of the lamp. With reference to FIG. 6A, simplified lamp voltage $V_{LAMP}$ versus angular frequency curves are shown. Angular frequency $\omega_R$ is the frequency of resonance of resonant load circuit 16 of FIG. 1. At resonance, lamp voltage $V_{LAMP}$ is at its highest value, shown as $V_R$. It is desirable for the lamp voltage to approach such resonant point during lamp ignition. This is because the very high voltage spike generated across the lamp at such point reliably initiates an arc discharge in the lamp, causing it to start. In contrast, during steady state operation, the lamp operates at a considerably lower voltage $V_{SS}$, at the higher angular frequency $\omega_{SS}$. Now, referring to FIG. 6B, the phase angle between the fundamental frequency component of resonant voltage between nodes 26 and 23 and the current in resonant load circuit 16 (FIG. 1) is shown. Beneficially, this phase angle tends to migrate towards zero during lamp ignition. In turn, lamp voltage $V_{LAMP}$ (FIG. 6A) migrates towards the high resonant voltage $V_R$ (FIG. 6A), which is desirable, as explained, for reliably starting the lamp.

Some of the prior art gate drive circuits, as mentioned above, resulted in the phase angle of the resonant load circuit migrating instead towards 90° during lamp ignition, with the drawback that the voltage across the lamp at this time was lower than desired. Less reliable lamp starting thereby occurs in such prior art circuits.

Second Aspect of the Invention

Figure 7:
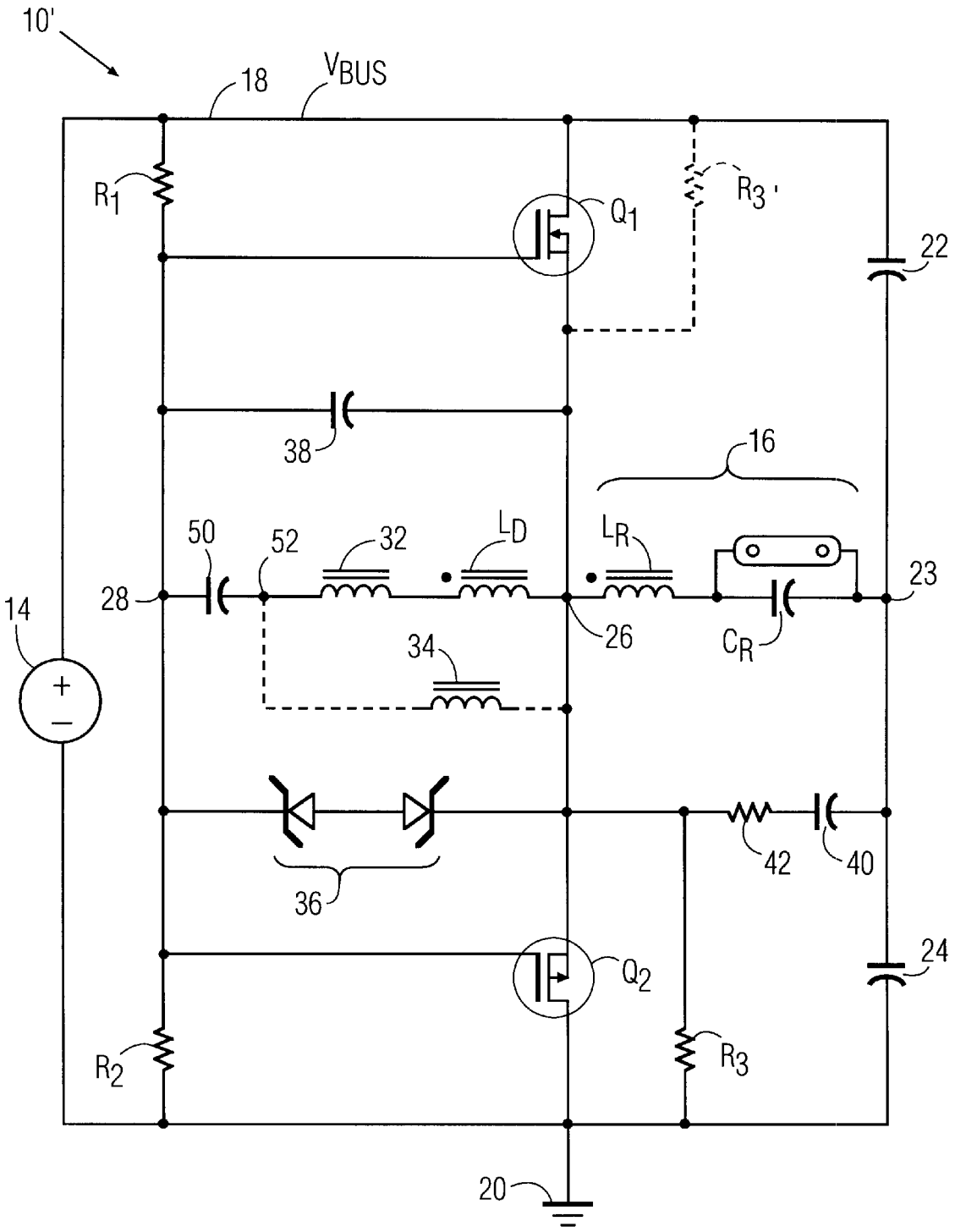
FIG. 7 is a schematic diagram similar to FIG. 1, but also showing a novel starting circuit in accordance with a second aspect of the invention.

A second aspect of the invention is now described in connection with FIGS. 7–8. In FIG. 7, a ballast circuit 10' is shown. It is identical to ballast 10 of FIG. 1, but also includes a novel starting circuit described below. As between FIGS. 1 and 7, like reference numerals refer to like parts, and therefore FIG. 1 may be consulted for description of such like-numbered parts.

The novel starting circuit includes a coupling capacitor 50 that becomes initially charged, upon energizing of source 14, via resistors $R_1$, $R_2$ and $R_3$. At this instant, the voltage across capacitor 50 is zero, and, during the starting process, serial-connected inductors $L_D$ and 32 act essentially as a short circuit, due to the relatively long time constant for charging of capacitor 50. With resistors $R_1$–$R_3$ being of equal value, for instance, the voltage on node 26, upon initial bus energizing, is approximately ⅓ of bus voltage $V_{BUS}$, while the voltage at node 28, between resistors $R_1$ and $R_2$ is ½ of bus voltage $V_{BUS}$. In this manner, capacitor 50 becomes increasingly charged, from left to right, until it reaches the threshold voltage of the gate-to-source voltage of upper switch $Q_1$ (e.g., 2–3 volts). At this point, upper switch $Q_1$ switches into its conduction mode, which then results in current being supplied by that switch to resonant load circuit 16. In turn, the resulting current in the resonant load circuit causes regenerative control of first and second switches $Q_1$ and $Q_2$ in the manner described above for ballast circuit 10 of FIG. 1.

During steady state operation of ballast circuit 10', the voltage of common node 26, between switches $Q_1$ and $Q_2$, becomes approximately ½ of bus voltage $V_{BUS}$. The voltage at node 28 also becomes approximately ½ of bus voltage $V_{BUS}$, so that capacitor 50 cannot again, during steady state operation, become charged and create another starting pulse for turning on switch $Q_1$. During steady state operation, the capacitive reactance of capacitor 50 is much smaller than the inductive reactance of driving inductor $L_D$ and inductor 32, so that capacitor 50 does not interfere with operation of those inductors.

Resistor $R_3$ may be alternatively placed as shown in broken lines as resistor $R_3'$, shunting upper switch $Q_1$ rather than lower switch $Q_2$. The operation of the circuit is similar to that described above with respect to resistor $R_3$ shunting lower switch $Q_2$. However, initially, common node 26 assumes a higher potential than node 28 between resistors $R_1$ and $R_2$ so that capacitor 50 becomes charged from right to left. The results in an increasingly negative voltage between node 28 and node 26, which is effective for turning on lower switch $Q_2$. Resistors $R_1$ and $R_2$ are both preferably used in the circuit of FIG. 7; however, the circuit will function substantially as intended with resistor $R_2$ removed and using resistor $R_3$ as shown in solid lines. The use of both resistors $R_1$ and $R_2$ may result in a quicker start at a somewhat lower line voltage. The circuit will also function substantially as intended with resistor $R_1$ removed and using $R_3$ as shown in dashed lines.

Beneficially, the novel starting circuit of ballast circuit 101 of FIG. 7 does not require a triggering device, such as a diac, which is traditionally used for starting circuits. Additionally resistors $R_1$, $R_2$ and $R_3$ are non-critical value components, which may be 100 k ohms or 1 megohm each, for example. Preferably such resistors have similar values, e.g., approximately equal.

Exemplary component values for the circuit of FIG. 7 (and hence of FIG. 1) are as follows for a fluorescent lamp 12 rated at 16.5 watts, with a d.c. bus voltage of 160 volts, and not including inductor 34:

| | |
|---|---|
| Resonant inductor $L_R$ | 570 micro henries |
| Driving inductor $L_D$ | 2.5 micro henries |
| Turns ratio between $L_R$ and $L_D$ | 15 |
| Second inductor 32 | 150 micro henries |
| Capacitor 38 | 3.3 nanofarads |
| Capacitor 50 | 0.1 microfarads |
| Zener diodes 36, each | 7.5 volts |
| Resistors $R_1$, $R_2$ and $R_3$, each | 1 megohm |
| Resonant capacitor $C_R$ | 3.3 nanofarads |
| Bridge capacitors 22 and 24, each | 0.22 microfarads |
| Resistor 42 | 10 ohms |
| Snubber capacitor 40 | 470 picofarads |

Additionally, switch $Q_1$ may be an IRFR210, n-channel, enhancement mode MOSFET, sold by International Rectifier Company, of El Segundo, Calif.; and switch $Q_2$, an IRFR9210, p-channel, enhancement mode MOSFET also sold by International Rectifier Company.

If inductor 34 is used in the embodiment of FIG. 7, the left-shown end of the inductor should be connected to node 52, i.e., the node between inductor 32 and capacitor 50, as shown.

Figure 8:
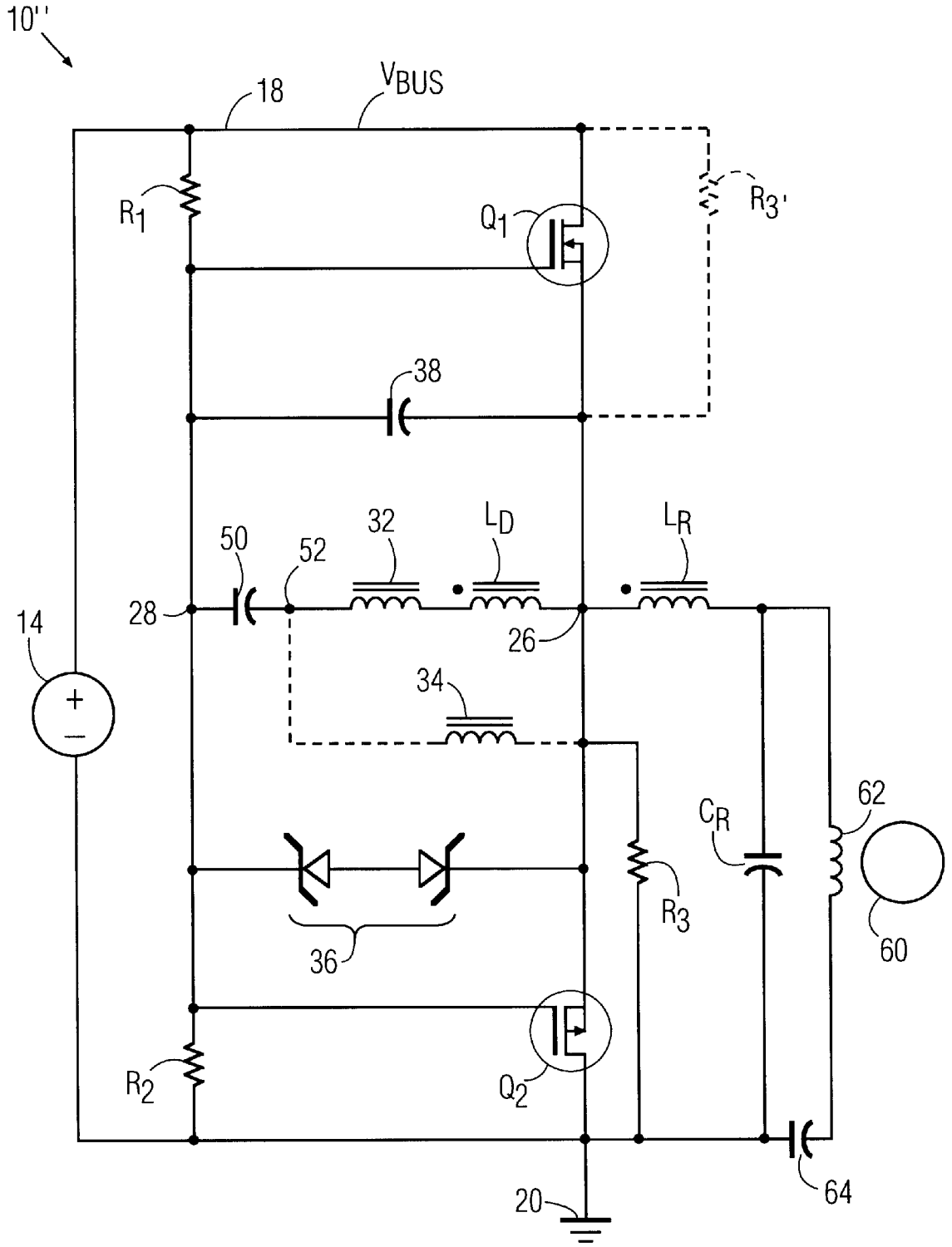
FIG. 8 is a schematic diagram showing a ballast circuit for an electrodeless gas discharge lamp that embodies principles of both the first and second aspects of the invention.

FIG. 8 shows a ballast circuit 10" embodying principles of the first aspect of the invention, and also embodying principles of the second aspect of the invention. As between FIGS. 1, 7 and 8, like reference numerals refer to like parts, and therefore FIGS. 1 and 7 may be consulted for description of such like-numbered parts. Circuit 10" is particularly directed to a ballast circuit for an electrodeless lamp 60, which may be of the fluorescent type. Lamp 60 is shown as a circle representing the plasma of an electrodeless lamp. An RF coil 62 provides the energy to excite the plasma into a state in which it generates light. A d.c. blocking capacitor 64 may be used rather than the bridge capacitors 22 and 24 shown in FIG. 1. Circuit 10" operates at a frequency typically of about 2.5 Megahertz, which is about 10 to 20 times higher than for the electroded type of lamp powered by ballast circuit 10 of FIG. 1 or circuit 10' of FIG. 7.

As with the circuit of FIG. 7, the circuit of FIG. 8 will function substantially as intended with resistor $R_2$ removed and using $R_3$ as shown in solid lines, or with $R_1$ removed and using $R_3$ as shown in dashed lines.

Operation of the novel starting circuit of ballast circuit 10" of FIG. 8 is essentially the same as described above for the ballast circuit 10' of FIG. 7.

Exemplary component values for the circuit of FIG. 8 are as follows for a lamp 60 rated at 13 watts, with a d.c. bus voltage of 160 volts, and not including inductor 34:

| | |
|---|---|
| Resonant inductor $L_R$ | 20 micro henries |
| Driving inductor $L_D$ | 0.2 micro henries |
| Turns ratio between $L_R$ and $L_D$ | 10 |
| Second inductor 32 | 30 micro henries |
| Capacitor 38 | 470 picofarads |
| Capacitor 50 | 0.1 microfarads |
| Zener diodes 36, each | 7.5 volts |
| Resistors $R_1$, $R_2$ and $R_3$, each | 1 megohm |
| Resonant capacitor $C_R$ | 680 picofarads |
| D.c. blocking capacitor 64 | 1 nanofarad |

Additionally, switch $Q_1$ may be an IRFR210, n-channel, enhancement mode MOSFET, sold by International Rectifier Company, of El Segundo, Calif.; and switch $Q_2$, an IRFR9210, p-channel, enhancement mode MOSFET also sold by International Rectifier Company.

If inductor 34 is used in the embodiment of FIG. 8, the left-shown end of the inductor should be connected to node 52, i.e., the node between inductor 32 and capacitor 50, as shown.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A ballast circuit for a gas discharge lamp, comprising:

(a) a resonant load circuit incorporating the gas discharge lamp and including a resonant inductance and a resonant capacitance;

(b) a d.c.-to-a.c. converter circuit coupled to said resonant load circuit for inducing an a.c. current in said resonant load circuit, said converter circuit comprising:

(i) first and second switches serially connected between a bus conductor at a d.c. voltage and a reference conductor, and being connected together at a common node through which said a.c. current flows;

(ii) said first and second switches each comprising a reference node and a control node, the voltage between such nodes determining the conduction state of the associated switch;

(iii) the respective reference nodes of said first and second switches being interconnected at said common node; and (iv) the respective control nodes of said first and second switches being directly interconnected;

(c) an inductance connected between said control nodes and said common node;

(d) a starting pulse-supplying capacitance connected in series with said inductance, between said control nodes and said common node;

(e) a network connected to said control nodes for supplying said starting pulse-supplying capacitance with charge so as to create a starting pulse during lamp starting; and (f) a polarity-determining impedance connected between said common node and one of said bus conductor and said reference conductor, to set the initial polarity of pulse to be generated by said starting pulse-supplying capacitor.

2. The ballast circuit of claim 1, wherein said inductance comprises:

(a) a driving inductor mutually coupled to said resonant inductor in such manner that a voltage is induced therein which is proportional to the instantaneous rate of change of said a.c. load current; and (b) a second inductor serially connected to said driving inductor, with the serially connected driving and second inductors being connected between said control nodes and said common node.

3. The ballast circuit of claim 1, wherein said network comprises a voltage-divider network connected between said bus and reference conductors.

4. The ballast circuit of claim 3, wherein said voltage-divider network comprises a pair of resistors connected between said bus and reference conductors.

5. The ballast circuit of claim 4, wherein:

(a) said polarity-determining impedance comprises a resistor; and (b) each of said pair of resistors has a resistance value approximately equal to the resistance value of said polarity-determining impedance.

6. The ballast circuit of claim 1, wherein said lamp comprises a fluorescent lamp.

7. The ballast circuit of claim 6, wherein said lamp comprises an electrodeless lamp.

8. A ballast circuit for a gas discharge lamp, comprising:

(a) a resonant load circuit incorporating the gas discharge lamp and including a resonant inductance and a resonant capacitance;

(b) a d.c.-to-a.c. converter circuit coupled to said resonant load circuit for inducing an a.c. current in said resonant load circuit, said converter circuit comprising:

(i) first and second switches serially connected between a bus conductor at a d.c. voltage and a reference conductor, and being connected together at a common node through which said a.c. current flows;

(ii) said first and second switches each comprising a reference node and a control node, the voltage between such nodes determining the conduction state of the associated switch;

(iii) the respective reference nodes of said first and second switches being interconnected at said common node; and (iv) the respective control nodes of said first and second switches being directly interconnected;

(c) an inductance connected between said control nodes and said common node, comprising:

(i) a driving inductor mutually coupled to said resonant inductor in such manner that a voltage is induced therein which is proportional to the instantaneous rate of change of said a.c. current; and (ii) a second inductor serially connected to said driving inductor, with the serially connected driving and second inductors being connected between said control nodes and said common node;

(d) a capacitance coupled between said control nodes and said common node for predictably limiting the rate of change of voltage between said control nodes and said common node;

(e) a starting pulse-supplying capacitance connected in series with said inductance, between said control nodes and said common node;

(f) a network connected to said control nodes for supplying said starting pulse-supplying capacitance with charge so as to create a starting pulse during lamp starting, and (g) a polarity-determining impedance connected between said common node and one of said bus conductor and said reference conductor, to set the initial polarity of pulse to be generated by said starting pulse-supplying capacitor.

9. The ballast circuit of claim 8, wherein:

(a) a bidirectional voltage clamp is connected between said control nodes and said common node for limiting positive and negative excursions of voltage of said control nodes with respect to said common node;

(b) said second inductor cooperating with said voltage clamp in such manner that the phase angle between the fundamental frequency component of voltage across said resonant load circuit and said a.c. current approaches zero during lamp ignition.

10. The ballast circuit of claim 8, wherein said network comprises a voltage-divider network connected between said bus and reference conductors.

11. The ballast circuit of claim 10, wherein said voltage-divider network comprises a pair of resistors connected between said bus and reference conductors.

12. The ballast circuit of claim 11, wherein:

(a) said polarity-determining impedance comprises a resistor; and (b) each of said pair of resistors has a resistance value approximately equal to the resistance value of said polarity-determining impedance.

13. The ballast circuit of claim 8, wherein said lamp comprises a fluorescent lamp.

14. The ballast circuit of claim 13, wherein said lamp comprises an electrodeless lamp.

15. The ballast circuit of claim 1, wherein said first and second switches are connected directly together at said common node.

16. The ballast circuit of claim 8, wherein said first and second switches are connected directly together at said common node.

* * * * *